US005178640A

United States Patent [19]

Girardi et al.

[11] Patent Number: 5,178,640

[45] Date of Patent: Jan. 12, 1993

[54] METHOD FOR PREPARING A SYNTHETIC FUEL AND/OR SYNTHETIC COMPONENTS FOR FUELS, AND THE PRODUCT OBTAINED THEREBY

[75] Inventors: Ermanno Girardi, S. Donato Milanese; Riccardo Mansani, Milan, both of Italy

[73] Assignee: ENI-Ente Nazionale Idrocarburi, Rome, Italy

[21] Appl. No.: 334,198

[22] Filed: Apr. 5, 1989

Related U.S. Application Data

[63] Continuation of Ser. No. 186,619, Apr. 27, 1988, abandoned, which is a continuation of Ser. No. 906,227, Sep. 11, 1986, abandoned, which is a continuation-in-part of Ser. No. 663,319, Oct. 22, 1984, abandoned.

[30] Foreign Application Priority Data

Nov. 10, 1983 [IT] Italy ..... 23659 A/83

[51] Int. Cl.[5] ..... C10L 1/18

[52] U.S. Cl. ..... 44/310; 560/1; 560/241.1

[58] Field of Search ..... 44/53, 56, 70, 76, 310, 44/363, 357, 389; 560/76, 96, 1, 241.1; 260/453

[56] References Cited

U.S. PATENT DOCUMENTS

| | | | |
|---|---|---|---|
| 1,517,968 | 12/1924 | Ellis | 560/241.1 |
| 1,995,615 | 3/1935 | Jalger | 44/70 |
| 2,891,991 | 6/1959 | Stewart et al. | 44/70 |
| 3,194,823 | 7/1965 | Suer et al. | 44/70 |
| 3,299,076 | 1/1967 | Kramer et al. | 44/70 |
| 4,133,841 | 1/1979 | Cosyns et al. | 260/676 R |
| 4,216,337 | 8/1980 | Baba et al. | 560/78 |
| 4,278,443 | 7/1981 | Beuther et al. | 44/56 |
| 4,338,456 | 7/1982 | Itatani et al. | 560/76 |
| 4,375,361 | 3/1983 | Lyons et al. | 44/56 |
| 4,381,406 | 4/1983 | Finley | 560/96 |
| 4,420,930 | 12/1984 | Beuther et al. | 44/56 |
| 4,609,376 | 9/1986 | Craig et al. | 44/70 |

FOREIGN PATENT DOCUMENTS

| | | |
|---|---|---|
| 0841141 | 4/1952 | Fed. Rep. of Germany . |
| 0864992 | 12/1952 | Fed. Rep. of Germany . |
| 0879103 | 4/1983 | Fed. Rep. of Germany . |
| 1347213 | 11/1963 | France . |

OTHER PUBLICATIONS

Kirk Othmer, Encyclopedia of Chemical Technology, vol. 8, pp. 341-345.

Advanced Organic Chemistry, 2nd ed. Part B: Reactions & Synthesis, Carey et al., Plenum Press, New York & London, p. 1434, 1984.

*Primary Examiner*—Margaret Medley

*Attorney, Agent, or Firm*—Hedman, Gibson & Costigan

[57] ABSTRACT

Synthetic fuel and/or synthetic components for fuels are prepared from a mixture of aromatic polycarboxylic acids of suitable elementary composition, having a mean molecular weight of between 120 and 800 and an acidity of between 5 and 18 meq/g by partially decarboxylating them by heat treatment and subjecting the non-removed acidic functions to esterification with one or more alcohols or one or more olefins. This invention relates to a method for preparing a synthetic fuel and/or synthetic components for fuels, and the product obtained by said method.

15 Claims, No Drawings

METHOD FOR PREPARING A SYNTHETIC FUEL AND/OR SYNTHETIC COMPONENTS FOR FUELS, AND THE PRODUCT OBTAINED THEREBY

Numerous methods exist for oxidizing coal with oxygen, oxygen-containing gases or oxidising substances in an aqueous alkaline medium.

A large percentage of the product of this oxidation consists of aromatic polycarboxylic acid mixtures.

Examples of methods for producing aromatic carboxylic acids by oxidising coal include those described in French patent 1,347,213 and in German patents 841,140; 864,992 and 879,103. The polycarboxylic acids obtained by known methods cannot be used as fuels because of their acidic nature, so that their use is practically limited to the chemical field.

It has been surprisingly found that aromatic polycarboxylic acid mixtures can be converted into fuels and/or components for fuels by transforming them into oleophilic compounds in a simple and economical manner.

Besides polycarboxylic acid mixtures obtained by oxidizing coal, polycarboxylic acid mixtures of any origin can obviously be used for transformation into oleophilic compounds provided that their elementary compositions, molecular weight and acidity lie within the limits indicated hereinafter.

A first subject matter of the present invention is a method for transforming aromatic polycarboxylic acid mixtures into oleophilic compounds which can be used as synthetic components for fuels and/or synthetic components for fuels.

The method for preparing a synthetic fuel and/or synthetic components for fuels according to the present invention starts with a aromatic polycarboxylic acid mixture obtained in any manner preferably by air oxidation of an aqueous alkaline suspension of a bituminous coal. The mixture may be characterized by polycarboxylic acids having the following elementary composition:

carbon from 42% to 70% by weight
hydrogen from 1.5% to 6% by weight
oxygen from 14.0% to 52.7% by weight, a mean molecular weight of between 120 and 800, and an acidity of between 5 and 18 meq/g, and preferably between 8 and 14 meq/g,. The mixture of polycarboxylic acids or their alkali or alkaline earth metal salts is subjected to partial decarboxylation as hereinafter explained. The partial decarboxylation can be effected in the case of acids, by first salifying in aqueous solution the acids with carbonates of alkaline or alkaline earth metals and then by heating the solution of the salts for a time of between 10 and 30 minutes, preferably 20 minutes, to a temperature of between 300° C. and 350° C., preferably 315° C., in the presence of a cupric carbonate or cupric sulphate or mixture thereof.

The partially decarboxylated products are recovered by extraction with an organic solvent such as methyl ethyl ketone (MEK).

In the case the starting mixture is a mixture of salts obviously the salifying step is absent.

The partial decarboxylation can alternatively be carried out for either the mixture of acids or the mixture of alkaline or alkaline earth metal salts, in the absence of water, in the presence of transition metal oxides, chosen among copper, thorium and cadmium oxides, as catalysts at a temperature of between 350° C. and 550° C., preferably 500° C., for a time of between 10 and 30 minutes, preferably 20 minutes. In such a case, that is when the decarboxylation is carried out in absence of water, the product does not need any extraction and can be utilized as such for the subsequent esterification.

The carboxyl oxygen is removed from 50% to 80% of the polycarboxylic acids, by weight.

The esterification is preferably effected with alcohols comprising 1 to 10 carbon atoms, the alcohols being in a mixture with $H_2SO_4$ (as catalyst) at a concentration of between 5% and 20% by weight, or with olefins comprising between 2 and 10 carbon atoms in the presence of conventional acidic catalysts (such as $BF_3$, $SnCl_4$, or $H_2SO_4$).

The temperature and pressure are in both esterification types in the range of from 20° to 100° C. and 1 to 20 atmospheres respectively. A second object of the present invention is the preparation of fuel and/or the synthetic components for fuels, when obtained by the aforesaid method.

A third object of the present invention is the preparation of fuel obtained by mixing the synthetic fuel and/or synthetic components according to the invention with products chosen from a medium petroleum distillate, a medium distillate from coal hydroliquefaction, the product of coal pyrolysis and particularly the mixture of benzene, toluene and xylenes, a fuel oil of petroleum origin, a mixture of aromatic hydrocarbons or a mixture of $C_1$–$C_{10}$ aliphatic alcohols.

EXAMPLE

An aqueous solution of 40 g of the sodium salt of a mixture of aromatic polycarboxylic acids obtained by oxidation of an aqueous alkaline suspension of Illinois No. 6 bituminous coal and having the elemental analysis C=49.9%; H=3.4%; N=0.6%; S=0.8%; O (by difference) 45.3% in 300 ml $H_2O$ is heated in an autoclave to 300° C. for 20 minutes in the presence of 2 g of Cu $SO_4$.

The partially decarboxylated product is recovered after acidification with sulphuric acid by MEK and has an oxygen content of 19.3%.

The recovered product is treated with ethanol in a mixture with $H_2SO_4$ (98%) at a concentration of 10% by weight under reflux conditions for 2 hours when 48% of the product is esterified. The esterified product is recovered by extraction with ethylic ether.

The extracted product is a viscous liquid having the composition C=74.4%; H=5.8%; N=0.7%; S=0.9%; O (by difference)=18.2%.

We claim:

1. A method for preparing a synthetic fuel and/or synthetic components for fuel from a polycarboxylic acid mixture, or their alkaline metal salts, said method comprising subjecting a polycarboxylic acid mixture that is derived from the oxidation of coal and has the following elemental composition:

carbon from 42% to 70% by weight
hydrogen from 1.5% to 6% by weight
oxygen from 14.0% to 52.7% by weight,
a mean molecular weight of between 120 and 800, and an
acidity of between 5 and 18 meq/g, to a partial decarboxylation process which comprises
salifying in aqueous solution the acids with carbonates of alkaline or alkaline earth metals in the case that such acids are not already in their salt form, and then heating the solution of the salts for a time of between 10 and 30 minutes, to a temperature of between 300° C. and 350° C. in the presence of a cupric carbonate or cupric sulphate or mixture thereof, recovering the partially decarboxylated products by extraction with an organic solvent and thereafter esterifying the partially decarboxylated product with one or more alcohols comprising 1 to 10 carbon atoms or one or more olefins comprising 2–10 carbon atoms.

2. A method for preparing a synthetic fuel and/or synthetic components for fuels as claimed in claim 1, characterized in that the polycarboxylic acid mixture has an acidity of between 8 and 14 meq/g.

3. A method for preparing a synthetic fuel and/or synthetic components for fuels as claimed in claim 1, where the organic solvent used as extractor is methyl ethyl ketone.

4. A method as claimed in claim 1, characterized in that the heating is effected to a temperature of 315° C.

5. A method as claimed in claim 1, characterized in that the decarboxylation time is 20 minutes.

6. A method for preparing a synthetic fuel and/or synthetic components for fuel from a polycarboxylic acid mixture, or their alkaline or alkaline earth metal salts, said method comprising subjecting a polycarboxylic acid mixture that is derived from oxidation of coal and has the following elemental composition:

carbon from 42% to 70% by weight
hydrogen from 1.5% to 6% by weight
oxygen from 14.0% to 52.7% by weight, a mean molecular weight of between 120 and 800, and an acidity of between 5 and 18 meq/g, to a partial decarboxylation process which comprises heating said carboxylic acid mixture or the mixture of their alkaline or alkaline earth metal salts in the absence of water at a temperature of between 350° and 550° C. for a time of between 10 and 30 minutes, in presence of metal transition oxides, and thereafter esterifying the partially decarboxylated product with one or more alcohols comprising 1 to 10 carbon atoms or one or more olefins comprising 2 to 10 carbon atoms.

7. A method for preparing a synthetic fuel and/or synthetic components for fuels as claimed in claim 6, wherein the polycarboxylic acid mixture has an acidity of between 8 and 14 meq/g.

8. A method for preparing synthetic fuel and/or synthetic components for fuels as claimed in claim 6 wherein the metal transition oxides are chosen among copper, thorium and cadmium oxides.

9. A method as claimed in claim 6, characterized in that the decarboxylation temperature is 500° C.

10. A method as claimed in claim 6, characterized in that the decarboxylation time is 20 minutes.

11. A method for preparing a synthetic fuel and/or synthetic components for fuels as claimed in claim 1, or 6 characterized in that the esterification is effected with alcohols comprising from 1 to 10 carbon atoms, said alcohols being used in $H_2SO_4$ solution at a concentration of between 5% and 20% by weight at a temperature of from 20° to 100° C. under a pressure of from 1 to 20 atmospheres.

12. A method for preparing a synthetic fuel and/or synthetic components for fuels as claimed in claim 1, or 6 characterized in that the esterification is effected with olefins comprising between 2 and 10 carbon atoms in the presence of conventional acidic catalysts at a temperature of from 20° to 100° C. under a pressure of from 1 to 20 atmospheres.

13. A synthetic fuel and/or synthetic component for fuels obtained by the method of claims 1, 2, 5, 11 or 12.

14. A fuel obtained by mixing synthetic fuel and/or the synthetic components for fuels, when obtained in accordance with claims 1, 2, 5, 11 or 12 with a product chosen from the group consisting of:

(a) medium petroleum distillate;
(b) medium distillate from coal hydroliquefaction;
(c) coal pyrolysis product, and in particular the mixture of benzene, toluene and xylenes;
(d) fuel oil of petroleum origins;
(e) mixture of aromatic hydrocarbon; and
(f) mixture of $C_1$–$C_{10}$ aliphatic alcohols.

15. A method for preparing a synthetic fuel and/or synthetic components for fuel as claimed in claim 1 wherein the partially decarboxylated product is esterified with ethanol.

* * * * *